United States Patent [19]

Nakano et al.

[11] 4,342,974

[45] Aug. 3, 1982

[54] MULTIPOLAR TYPE CIRCUIT BREAKER

[75] Inventors: Kunimitsu Nakano; Kunio Takemura, both of Kadoma, Japan

[73] Assignee: Matsushita Electric Works, Ltd., Osaka, Japan

[21] Appl. No.: 214,712

[22] Filed: Dec. 9, 1980

[51] Int. Cl.[3] ..... H01H 71/24

[52] U.S. Cl. ..... 335/10; 335/22; 335/35; 337/48

[58] Field of Search ..... 335/8, 10, 22, 35, 36, 335/103, 128, 173, 186; 337/46, 47, 48

[56] References Cited

U.S. PATENT DOCUMENTS 4,079,345 3/1978 Pietsch ..... 335/10

*Primary Examiner*—L. T. Hix
*Assistant Examiner*—S. D. Schreyer
*Attorney, Agent, or Firm*—Burns, Doane, Swecker & Mathis

[57] ABSTRACT

A multipolar type circuit breaker has a plurality of breaker element assemblies corresponding to AC source pole number. Each assembly comprises a contact operating mechanism for ON and OFF operations of a movable contactor connected to a load side terminal with respect to a fixed contactor connected to a current source side terminal. A trip mechanism forms an electric current path between the movable contactor and the load side terminal an interlinks with the contact operating mechanism for releasing its normal ON position latch with respect to the movable contactor upon incoming of a excessive curent to arbitrarity trip ON state. The assemblies are housed in a single housing in a mutually parallel and aligning relation. The contact operating mechanisms in all assemblies are operated by a single handle extending transversely to them within the housing. The tripping operation of the trip mechanism in any of the assemblies is synchronously transmitted at a high speed to other assemblies through a single interlinking rod also extending transverse to all the assemblies and holds the handle at a neutral position between its ON and OFF positions.

9 Claims, 12 Drawing Figures

56
54
54b
54b
54a
22
27
26

47
12
12
55
32
Aa(Aá,Aá)
8
29a
24
20
29
23d
23c
23a
23c
23b
53
8a
21
18
41a
25
45c
41
40
36b
45
45a
39
36
36a
11
45b
11
36a
37
38
35
42
33
34
31
17a
29a
28a
a
32
28
17
43
29
16
10
Ab(Ab',Ab")
30
44
10a
53
50c
52
48
7
50
50a

MULTIPOLAR TYPE CIRCUIT BREAKER

This invention relates to circuit breakers and, more particularly, to improvements in a circuit breaker including a plurality of circuit making and breaking element assemblies for a plurality of source current poles. Each assembly has a trip mechanism arranged between a current source and a load circuit to break the circuit at a high speed by forcibly tripping a movable contactor normally operated by a contact operating mechanism out of a closing position with a fixed contactor in response to an excessive current accompanying an overload or such accident as a short circuit in the load circuit.

In conventional circuit breakers of the kind referred to, it has been usual that each element assembly is contained separately in a case made of an insulative material for housing only a single assembly, and that two or three sets of such separately encased assemblies (depending on the number of poles of the desired alternating current source) are combined in parallel and aligned relation to each other. In such combination, an operating handle or lever connected to the trip mechanism and contact operating mechanism in each assembly is exposed out of the case. The cases of the respective sets are integrally fastened so that the respective levers will be substantially aligned with each other. Further, a single interlinking handle is mounted so that all the levers can be simultaneously operated by this single connecting handle and the trip operation in either one of the assemblies can be transmitted to the levers in other assemblies. In this arrangement, therefore, there is a possibility that slight dimensional and positional errors are produced in the respective cases of the assemblies which are made by molding, and errors are produced in the relative positions between the handles of the respective assemblies and in their relations to the interlinking handle. Such errors cause a time lag to occur in the trip operation transmission from the contact operating mechanism in one assembly to that in other assemblies, which results in a defect that the reliability in respect to the synchronism or speediness of the circuit breaking operation throughout the all assemblies is low.

It has been further common, that the circuit breaker of the kind referred to is provided with a means for indicating an accidental state of the circuit in which the contactors are tripped due to the excessive current. For this purpose, the breaker is provided with a separate indicator operatively connected with the trip mechanism or there is taken such measure that the trip state is indicated by holding the interlinking handle in the intermediate position between the ordinary contact opening and closing positions. However, the separate indicator naturally causes the arrangement of the breaker as well as its assembling work, to be complicated. In the case of holding the handle in the intermediate position, a trip link is inserted between the contact operating and trip mechanisms and the handle to transmit the handle opening and closing operations to both mechanisms in the respective assemblies. This trip link remains in a stable neutral position of respective springs in the mechanisms to hold the handle in the intermediate position at the time of the trip operation. The link is comparatively large in size; the arrangement and formation of the springs are complicate and, as a result, the synchronous high speed breaking of the all breaker element assemblies is thereby hindered.

In order to transmit the trip operation in one assembly to the other assemblies, it has been also, to provide an interlocked tripping member common to the trip mechanisms in all the assemblies. In such case, a latch link for the trip mechanism in each assembly is provided which engages with the interlocked tripping member. However, the trip operation in each assembly must be performed against loads on the latch links in the other assemblies, whereby there are caused such problmes that the trip operational load becomes large. As a result, any fluctuation between latch loads in the respective trip mechanisms is large, and the time required for tripping the trip mechanisms as well as the contact operating mechanisms in all the assemblies is thereby caused to fluctuate remarkably.

Referring further to the trip mechanism, there has been also suggested that a heat-responding element such as a bimetal plate, together with an electromagnetic means, can be incorporated in the current flow path of an excessive current so that both of them can perform the current detection and trip operation simultaneously. Alternately the heat-responding element can operate so as to attain the trip operation only with this element even when the excessive current is insufficient for causing the electromagnetic means to be thereby operated. In such case, however, the heat-responding element is engaged directly with the foregoing operatively commonly interlocked tripping member and the operation of the element is transmitted to the trip mechanisms in the respective other assemblies through this tripping member. Therefore, in this case, too, there are such problems that the latch link loads in all the assemblies are applied to the heat-responding element in one assembly in the same manner as has been described and the load on the trip operation becomes large. As a result, any fluctuation in the latch load in the respective assemblies becomes large; the fluctuation in the time required for the tripping becomes large; and the reliability of the trip operation is deteriorated.

In the circuit breakers of the kind referred to, a plurality of the breaker element assemblies respectively including the contact operating and trip mechanisms are combined so that, in assembling them, comparatively many component parts must be handled. On the other hand, after the completion of the assembly of all the assemblies or at the time of the maintenance inspection, the trip operation can be checked manually with respect to each of the assemblies but the interlinking operation of all the assemblies must be checked usually by passing an excessive current.

The present invention has been suggested in considerations of these problems in the conventional circuit breakers. A primary object is, therefore, to provide a multipolar type circuit breaker which is simple in structure for the interlinking operation between the respective breaker element assemblies for each source current pole and is high in reliability in respect to synchronism and speediness of the tripping operation throughout all of the assemblies. In particular, a multipolar type circuit breaker wherein, in each assembly including the trip mechanism and contact operating mechanism, the structure for the contact making and trip operations is simplified; the arrangement for the interlinking trip operation beteeen the respective assemblies is correspondingly simple; and the interlinking performance is positive is provided by the present invention.

Another related object of the present invention is to provide a multipolar type circuit breaker wherein the tripping load is reduced and, therefore, the interlinking trip operation is stable and reliable.

A further related object of the present invention is to provide a multipolar type circuit breaker wherein the trip state of the contacts can be simply and stably indicated with the stable and reliable interlinking trip operation between the respective breaker element assemblies for all the source current poles.

Another object of the present invention is to provide a multipolar type circuit breaker wherein the integrating assembly work of the respective breaker element assemblies for all the source current poles is simple and easy and yet a reliable interlinking operation can be easily attained without involving any positional and operational errors between the respective assemblies in respect of the interlinking trip operation.

A further related object of the present invention is to provide a multipolar type circuit breaker wherein the interlinking trip operation test after the assembling of all the breaker element assemblies or at the time of the maintenance inspection can be simply manually made.

A further related object of the present invention is to provide a multipolar type circuit breaker which is quick and reliable in the interlinking trip operation, can be used stably for a long time and is still low in the manufacturing costs.

Other objects and advantages of the present invention shall become clear as the following descriptions of the invention advance as detailed with reference to preferred embodiments of the invention shown in accompanying drawings, in which:

FIG. 3 is a sectioned side view of the breaker along line III—III in FIG. 1 in the state of contact ON;

Figure 6A:
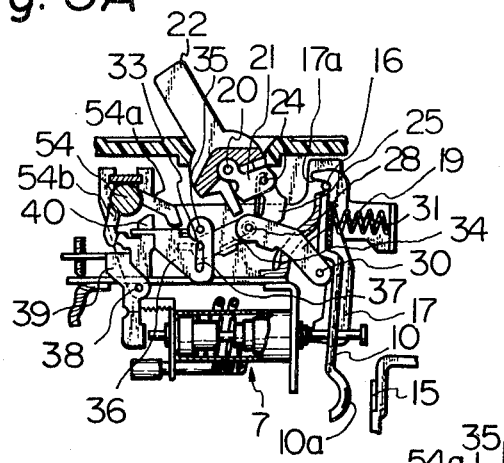
FIGS. 6A to 6C are fragmentary sectioned side views similar to FIG. 3, respectively showing the state of normal contact OFF, an abnormal contact OFF state as tripped from the ON state by a trip mechanism operated by an excessive current, and another abnormal contact OFF state as tripped from the ON state by a heat-responding element due to the excessive current.
Figure 6B:
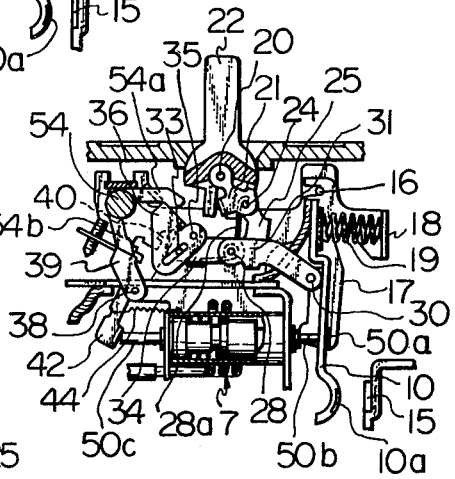
Figure 7A:
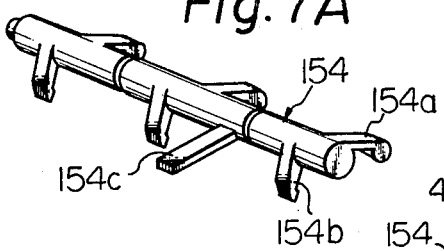
Figure 7B:
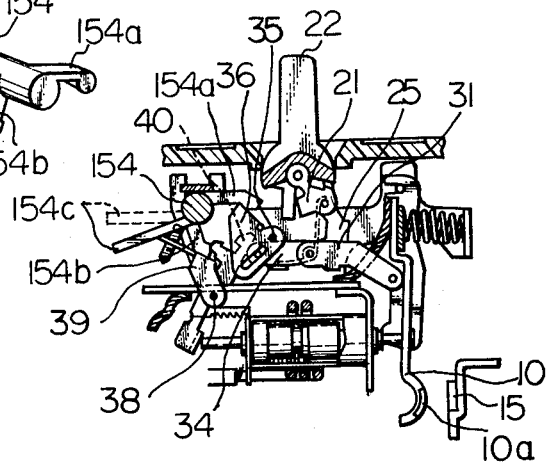
Figure 8A:
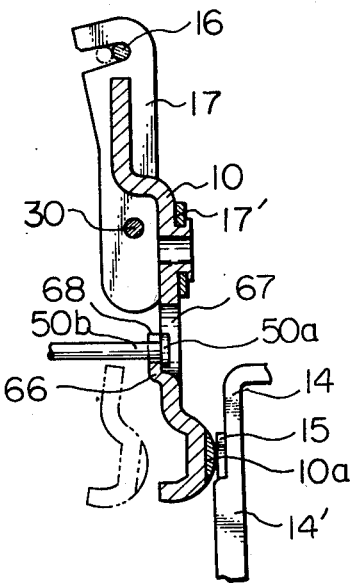
Figure 8B:
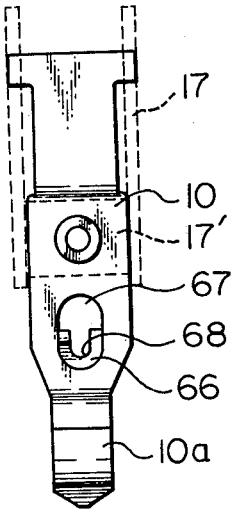

FIGS. 7A and 7B are respectively a perspective view of a trip operation interlinking rod in another embodiment of the present invention, and a fragmentary sectioned side view of the same state as in FIG. 6B when a test trip operation is made with the interlinking rod; and FIGS. 8A and 8B are, respectively, a side sectioned view and a plan view mainly of a movable contactor for showing an engaging arrangement between the contactor and a plunger head of an excessive current detecting means in a further embodiment according to the present invention for preventing an arc from being generated between the plunger head and a fixed contactor upon the high speed trip operation in the present invention.

While the present invention shall be hereinafter detailed with reference to the preferred embodiments shown in the drawings, its intention is not to limit the present invention to the particular embodiments shown, but rather to include all possible modifications, alterations and equivalent arrangements within the scope of appended claims.

Figure 1:
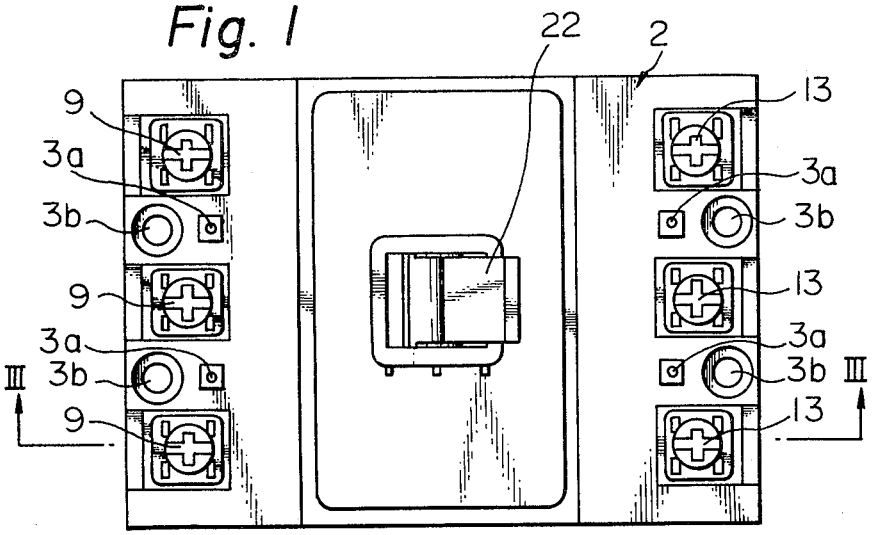
FIG. 1 is a plan view of a circuit breaker for a three-phase alternating current source according to an embodiment of the present invention.
Figure 2:
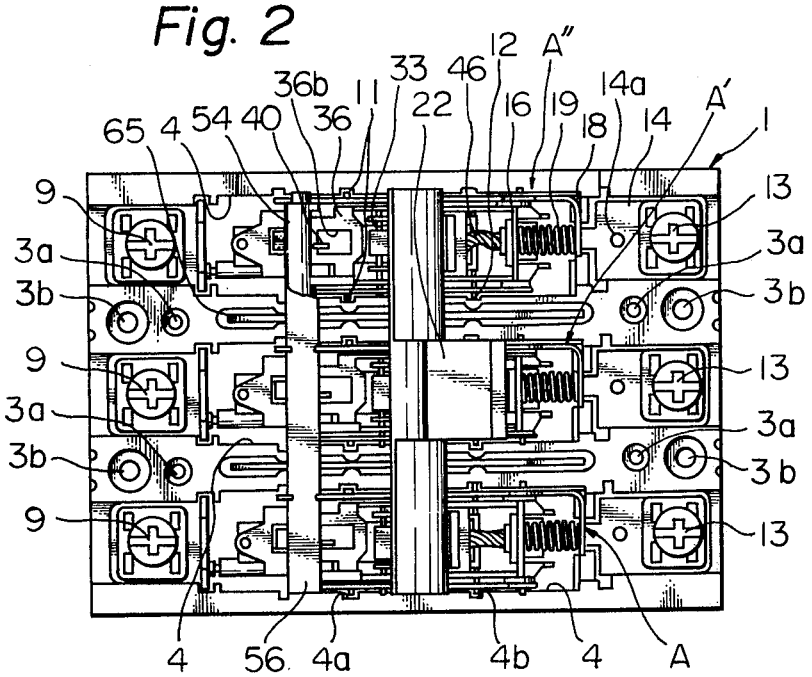
FIG. 2 is a plan view of the breaker shown in FIG. 1 with its cover removed.
Figure 3:
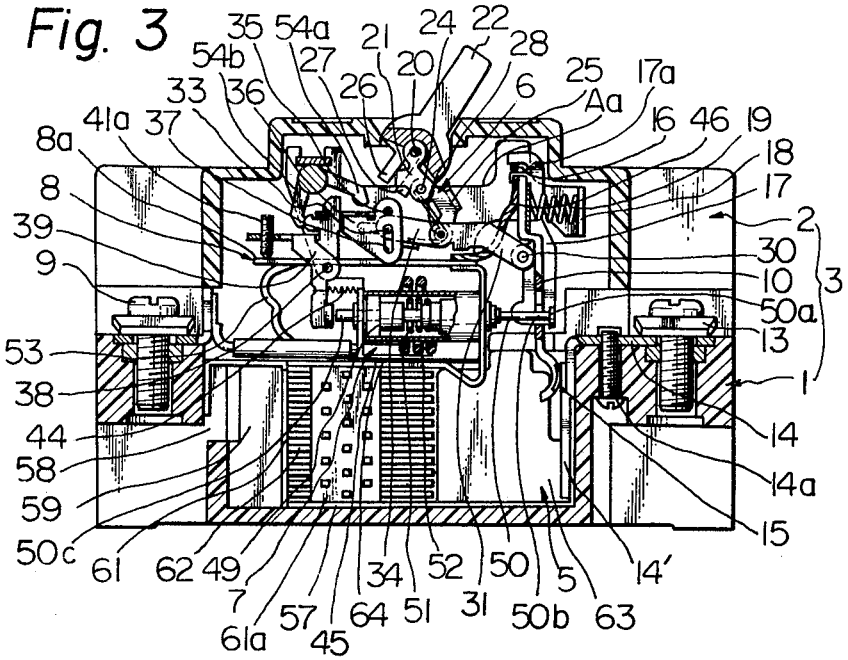

Referring first generally to the entire structure of the circuit breaker according to an embodiment of the present invention with reference to FIGS. 1 to 3, the circuit breaker includes three breaker element assemblies adapted to a three-phase alternating current source. Each assembly comprises fixed and movable contactors, current source side and load side terminals respectively connected to these contactors, a contact operating mechanism operatably connected with the movable contactor, a trip mechanism interlinked with the contact operating mechanism and electrically connected between the movable contactor and the load side terminal, and a means for suppressing arcs at the time of tripping the movable contactor. These assemblies are housed and fixed in the same case 1 made of an insulative material and having three grooves or channels 4 respectively adapted to mount thereto each of the assemblies separately from one another. In such case, mostly the arc suppressing means 5 and fixed contactor of each assembly are contained in each groove 4 of the case as seen in FIG. 3. Both terminals, and movable contactor arranged between them and respective mechanisms are disposed on the case. A trip operation interlinking rod and handle common to the respective assemblies as will be described later are transverse all assemblies. A single cover 2, made of an insulative material and covering the whole assemblies while exposing only both of the terminals in each assembly and a knob or lever portion of the handle, is fitted to the case 1 to form an integral breaker housing 3. The cover 2 is fixed to the case 1 with screws at communicating holes 3*a* and the housing 3 is installed to a switchboard or the like at through holes 3*b*.

In order to fix the respective assemblies to the case 1, positioning guide slits 4*a* and 4*b* are formed in side surfaces of the groove 4 Projections 11 and 12 of respective frames A through A″ respectively integrally hold a contact mechanism 6, a trip mechanism including an excessive current senser 7 of an electromagnetic device and a heat-responding element 8 of a bimetal. A load side terminal 9 and a movable contactor 10 are inserted respectively into the slits 4*a* and 4*b* so as to support the respective assemblies. A current source side terminal 13 has a fixed contactor 14 connected to it and is fixed to the case 1 with a screw 14*a*. A fixed contact 15 is secured to the fixed contactor 14 which is further formed to have a stepped part flush with the surface of the fixed contactor 15 so as to act as an arc running part 14′.

Figure 5:
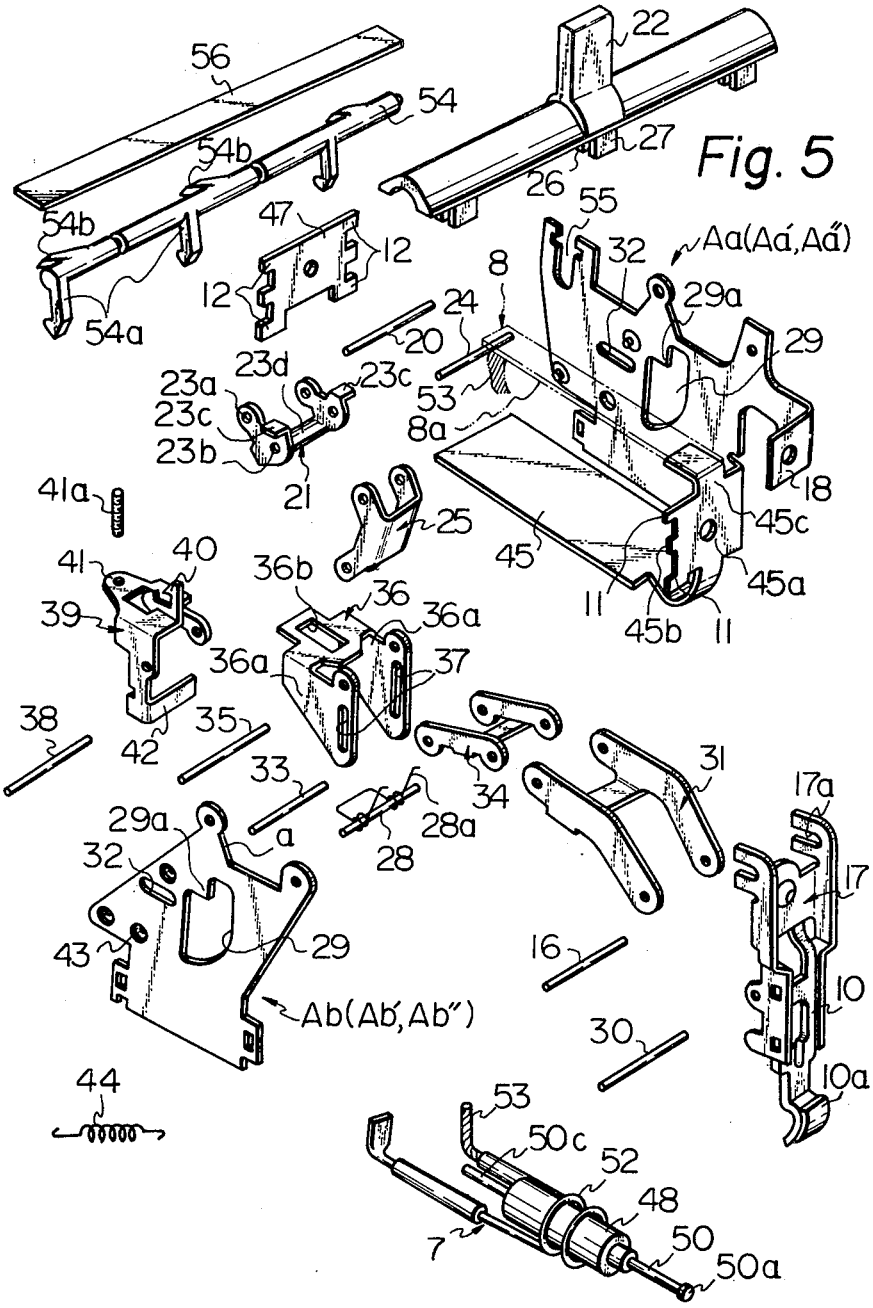
FIG. 5 is a perspective view showing as disassembled the respective parts including the trip and contact operating mechanisms of only one of the breaker element assemblies shown in FIGS. 1 to 4 and the trip operation interlinking rod and handle coupled to all the assemblies.

Each of the frames A, A′, A″ supporting each of the assemblies comprises a combination of two metal plates Aa and Ab in FIG. 5, wherein a pivot shaft 16 for opening and closing the contact is mounted on one end side of the upper part of the frame. Groove-shaped bearing grooves 17*a* of an opening and closing plate 17 which hold the movable contactor 10 are engaged with the shaft 16. A return spring 19 for the movable contactor is fitted between a supporting part 18 bent from one plate Aa of the frame at a lower part of the pivot shaft 16 and the opening and closing plate 17. Further, a handle supporting shaft 20 is mounted in the middle of the upper parts of the both frame plates; a handle link 21 is pivoted to the shaft 20; and a handle 22 which comprises a main shaft part extending within the cover 2 transversely of all of the assemblies. A lever part projecting out of the cover is removably fitted to the supporting shaft 20. The handle link 21 is substantially U-shaped as seen in FIG. 5 and has shaft holes 23*a* and 23*b* formed in the upper and lower parts of its both end arms. The handle supporting shaft 20 is fitted through both shaft holes 23*a*. A turning shaft 24 is inserted through both of the other shaft holes 23*b*. A turning link 25 is pivoted at both arms of one end to the turning shaft 24. A bent stopper part 23*c* engaging with the handle is formed in respective end pieces of the handle link 21 coupled by an intermediate coupling part 23*d*. On the other hand, the single handle 22 has three pairs of holding legs each consisting of a pair of legs 26 and 27 projecting out of the main shaft part, whereby the handle 22 is fitted in common to all the assemblies by holding the handle supporting shaft 20 and the intermediate coupling part 23*d* of the handle link 21 between the respective legs 26 and 27 and the handle 22 and link 21 are made to rotate integrally with respect to the shaft 20.

The arms at the other lower end of the turning link 25 are provided with an interlinking shaft 28 which is passed at both ends through trip state positioning windows 29 of the both frame plates. A connecting shaft 30 is provided below the fitting position of the return spring 19 for the opening and closing plate 17. A main link 31 is pivoted at both ends between the interlinking shaft 28 and the connecting shaft 30.

The respective frames are formed to have a pair of opposing horizontal slots 32 in the diagonally downward position of the handle supporting shaft 20 on the sides opposed to the main link 31. A movable shaft 33 is movably provided across these slots 32. A tripping link 34 is pivoted at both ends between this movable shaft 33 and the interlinking shaft 28. A return spring 28*a* for the trip operation and consisting of a twisted coil spring is supported at its intermediate twisted portion by the interlinking shaft 28 so as to resiliently engage at both ends with the turning link 25 and the tripping link 34. A latch link supporting shaft 35 is mounted as fixed in the parts adjacent and above the horizontal slots 32 of the both frame plates. A latch link 36 is rockably pivoted at one end to this shaft. The movable shaft 33 projecting out of both sides of the tripping link 34 is inserted between vertical slots 37 formed in a pair of opposing side plates 36*a* of the latch link 36 so that the latch link 36 can be rotated about the fixed supporting shaft 35 by the horizontal movement of the tripping link 34 and movable shaft 33 along the horizontal slots 32. The latch link 36 is provided also with a latch engaging hole 36*b* in a part coupling both side plates of the link.

As seen in FIG. 5, a tripping lever supporting shaft 38 is fixedly mounted at a further diagonally downward position from the horizontal slots 32 of both frame plates Aa and Ab. A tripping lever 39 is pivoted substantially in the middle of this supporting shaft 38. This tripping lever 39 is provided with an integral hook-shaped projection 40 which projects in an upward direction from the shaft 38 and engages with the latch engaging hole 36*b* of the latch link 36 to hook on the edge part of this hole 36*b*. The lever 39 is also provided with pressure sensing arms 41 and 42 bent for receiving pressures from a later described bimetal means and a plunger of the excessive current senser 7 at positions respectively above and below the shaft 38. A return spring 44 for this tripping lever 39 is hung between the plunger-pressure sensing arm 42 below the shaft 38 and a hole 43 made in the frame plate Ab so as to normally bias the lever 39 in the direction of separating the hook 40 away from the latch link 36.

Further, one frame plate Aa of the respective frames has a bent part 45*a* substantially parallel with the supporting part 18 at one lower end part. The other frame plate Ab is calked to projections 45*b* made at the tip of the bent part 45*a* so as to be joined with the frame plate Aa. An upper arc running plate 45 is horizontally extended from the lower end of the bent part 45*a*. The bimetal plate 8 to be used as a heat-responding element is welded at its one longitudinal base end to an upper end part 45*c* of the bent part 45*a*. The bimetal plate 8 is connected at this base end part to the upper end part of the movable contactor 10 through twisted copper wires 46 and is closely opposed at the other free end 8*a* to an adjusting screw 41*a* provided in the bimetal-pressure sensitive arm 41 of the tripping lever 39. A coil cylinder 48 of the electromagnetic means forming the excessive current senser is mounted between the bent part 45*a* of the frame and a fitting plate 47 fixed between both frame plates near the extended end of the arc running plate 45. A fixed iron core 49 is fixed on the side of the fitting plate 47 of the coil cylinder 48. A plunger 50, passing through the iron core 49 and coil cylinder 48 and having a movable iron core in the middle, is slidably arranged. A return spring 51 is interposed between the movable iron core of the plunger 50 and the fixed iron core 49. The plunger 50 passed through the movable contactor 10 at one end 50*b* as projected out of the bent part 45*a* and having a flange 50*a* at the tip. The plunger 50 and is closely opposed to the plunger-pressure sensing arm 42 of the tripping lever 39 at the other end 50*c* projecting out of the fitting plate 47. An exciting coil 52 is wound on the outer periphery of the coil cylinder 48. One end of this coil 52 is connected with the free end 8*a* of the bimetal plate 8 through flexible twisted copper wires 53 and the other end of the coil 52 is welded to the load side terminal 9. The plunger 50 is normally biased to the side of the bent part 45*a* by the return spring 52 so as to position the tip flange 50*a* further out of the movable contactor 10 to allow the movable contactor free to rotate to the fixed contact side.

A trip-operation interlinking rod 54 is rotatably fitted in a groove 55 of one frame plate Aa, Aa′ or Aa″ of the respective frames particularly for synchronously interlinking the respective trip mechanisms or contact operating mechanisms of the three assemblies respectively formed in the same manner as has been described above and housed in the single case 1. This interlinking rod 54 has three pairs of legs 54*a* and 54*b* projecting mutually substantially at right angles from the axis of the rod so that, when the interlinking rod is fitted, one leg 54*a* of each pair will be arranged on the coupling part of the latch link 36 in each assembly and the other leg 54*b* will be in contact with the projection adjacent the hook 40 of the tripping lever 39. Thus, when an excessive current flows through the assembly of either phase to operate the tripping lever 39, the latch link 36 in the particular assembly is operated to rotate and kick up the leg 54*a* in the same assembly the synchronous trip interlinking rod 54 will rotate about its axis. At the same time, the respective legs 54*b* of the rod disposed in the other assemblies will push and operate the respective tripping levers 39 in these assemblies, whereby the breaking operations of all the assemblies will be simultaneously performed. Reference numeral 56 denotes a pressing plate for the simultaneous trip interlinking rod 54 and this place 56 is engaged in respective cuts made in the upper parts of the groove 55 in the respective frame plates Aa, Aa' and Aa'' to prevent the rod from escaping the groove while allowing its axial rotation.

In such formation as has been disclosed, the movable contact 10*a* at the tip of the movable contactor 10, which is rotatable together with the opening and closing plate 17 with respect to the pivoting shaft 16, extends into the groove 4 of the case 1. The contact 10*a* is opposed to the fixed contact 15 which is connected to the current source side terminal 13 fitted to the case 1 and positioned within the groove 4. Further, the interlinking hand 22 and rod 54 are preferably made of an insulative material for simplifying the formation since they engage directly with the handle links, tripping levers and the like which are coupled to members forming the electric path between the contactor 10 and the terminal 9.

Now, the arc suppressing means 5 provided within the groove 4 of the case 1 shall be briefly referred to. As shown in FIG. 3, a lower arc running plate 57 is laid as continued to the fixed contactor 14 on the bottom surface of the groove 4 of the case 1. A gas venting hole 58 is formed in the side wall of the side opposed to the side on which the fixed contact 15 and movable contact 10*a* are positioned. A guide supporting pillar 59 is erected integrally with the case 1 in front of the gas venting hole 58. An insulative exhaust plate 61 having exhaust ports formed therethrough is erected as supported by the guide supporting pillar 59 and the groove's side surfaces. A deion grid 62 supported in close contact with a block plate 61*a* is set just before the exhaust plate 61. Arc gas reflux plates 63 made of ceramics are set on each side in front of the deion grid 62. Reference numeral 64 denotes an insulating plate laid on the upper surface of the arc running plate 45. As seen in FIG. 2, an insulative plate 65 forms a partition between the respective assemblies, and the parts of the respective frames supporting the handle supporting shaft 20 and interlinking rod 54 project out of the insulative plates 65 so as to allow the handle 22 and rod 54 to be mounted in common to the all assemblies.

Figure 4:
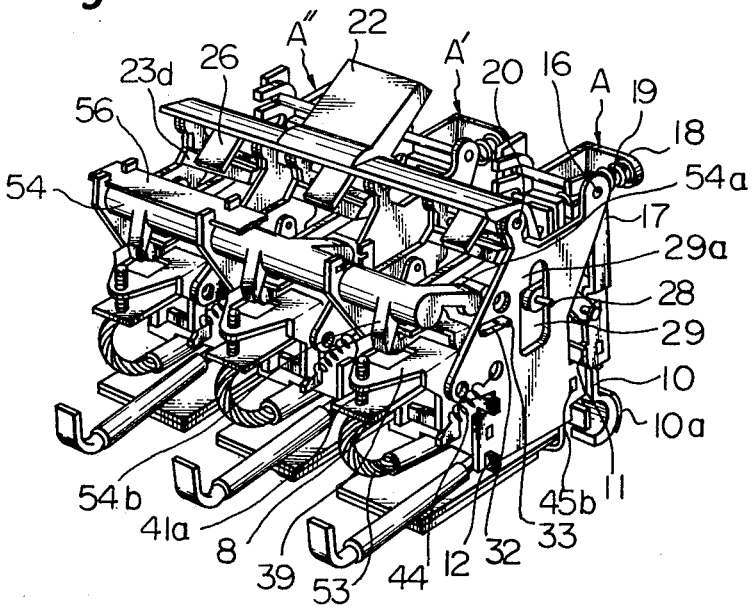
FIG. 4 is a perspective view of the breaker shown in FIG. 1 with the cover and case removed.

The operation of this circuit breaker shall be explained next. In the ON-state as shown in FIGS. 3 and 4, the tripping lever 39 is erected vertically as shown in the drawings by the return spring 44, the latch link 36 engages with the hook 40 of the tripping lever 39, the handle 22 is rotated rightward in the drawings, the stoppers 23*c* of the handle link 23 are pushed by the lower surface of the main shaft part of the handle to rotate the handle link 21 to a substantially upright position about the shaft 20 as a center, and the turning shaft 24 is rotated to shift to the position of FIG. 3. In this state, the latch link 36 is held substantially in its upright position by the hook 40 of the lever 39 so that the movable shaft 33 will be latched in a position where the horizontal slot 32 and vertical slot 37 are intersecting each other substantially at right angles. As the trip link 34 is supported by the movable shaft 33, the interlinking shaft 28 is moved downward by the turning link 25, the trip link 34 and main link 31 are thereby extended to be substantially horizontally linear as shifted from a triangle position with the interlinking shaft 28 as an apex. The connecting shaft 30 is moved rightward in the drawing, and the opening and closing plate 17 is rocked about the supporting shaft 16 against the force of the return spring 19. The movable contact 10*a* of the movable contactor 10 is in resilient contact with the fixed contact 15. Further, a contact pressure is given to the movable contact 10*a* by the spring 19 due to a rotary moment acting with the connecting shaft 30 as the center. In such case, the opening and closing plate 17 is caused to move slightly with respect to the pivoting shaft 16 within its bearing groove 17*a*. Further, in this state, the interlinking shaft 28 of the main link 31 is biased upwardly by the resiliency of the return spring 19, and the turning shaft 24 of the turning link 25 is shifted leftwardly in the drawing with respect to the line connecting the handle supporting shaft 20 with the interlinking shaft 28 and is biased in the leftward direction. On the other hand, the stoppers 23*c* are locked in the recess a (FIG. 5) at the upper end of the frame A so as to be stable. Thus the electric path to the load circuit is closed as formed by the current source side terminal 13, fixed contactor 14, fixed contact 15, movable contact 10*a*, movable contactor 10, twisted copper wires 46, bimetal plate 8, twisted copper wires 53, coil 52 and load side terminal 9.

The ordinary OFF-state is as shown in FIG. 6A. This state is obtained from the foregoing ON-state by rotating the handle 22 to fall leftwardly in the drawing. As the interlinking shaft 28 is biased upward by the return spring 19 as referred to above, the turning shaft 24, reversely rotated over the line connecting the handle supporting shaft 20 with the interlinking shaft 28 due to the leftward rotation of the handle 22, causes the interlinking shaft 28 to move up strongly due to the action of the return spring 19 so as to rotate the handle 22 leftward, while drawing the connecting shaft 30 leftward. The movable contact 10 is separated from the fixed contact with the pivoting shaft 16 as the center. In such case, until the turning shaft 24 rotates over the line connecting the handle supporting shaft 20 with the interlinking shaft 28 due to the leftward rotating operation of the handle 22, the movable contactor 10 will be in a range before the engagement of the bearing groove 17*a* with the pivoting shaft 16 and the fixed contact 15 and movable contact 10*a* are still in contact with each other.

Figure 6C:
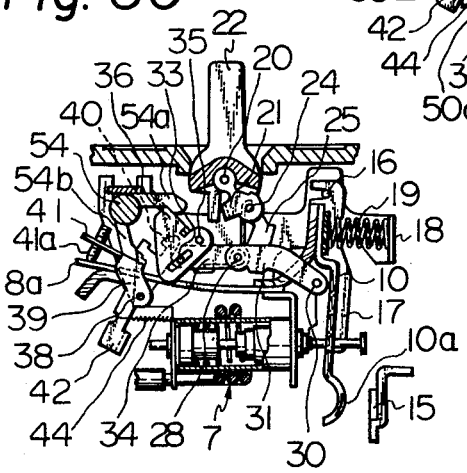

The trip state is shown in FIGS. 6B and 6C. Upon an incoming of an excessive current (at which the senser 7 still does not operate) flowing through the current path in the ON-state of FIG. 3 (FIG. 6C) the bimetal 8 will generate heat so as to curve upward at the free end 8*a* and will press the adjusting screw 41*a* of the bimetal-pressure sensing arm 41 of the tripping lever 39, whereby the lever 39 will rock about the supporting shaft 38 and the hook 40 will disengage from the engaging hole 36*b*. When the hook 40 disengages, due to the resiliency component of the return spring 19 imparted to the movable shaft 33 through the main link 31 and trip link 34, the movable shaft 33 will move in the horizontal slot 32 of the frame to incline the vertical slot 37 of the latch link 36 and will rotate the latch link 36 about the supporting shaft 35. The interlinking shaft 28 attached to the main link 31 will move horizontally leftward in the drawing at the same time, whereby the turning shaft 24 of the turning link 25 will be positioned on the opposite side of the line connecting the interlinking shaft 28 with the handle supporting shaft 20. The turning shaft 24 will be reversely biased by the return spring 28*a*, the handle link 21 will be thereby rotated about the handle supporting shaft 20 and the handle 22 will be rotated leftwardly by the stopper 23*c* and engaging part 23*d* of the handle link 21. Then, the interlinking shaft 28 will move upward from the state of the horizontal movement, the shaft 28 will engage at the extended both ends with the positioning projected edge parts 29*a* of the trip state positioning windows 29 of the frame (see FIGS. 4 and 5), the handle 22 will be maintained in a substantially upright neutral state and the trip state will be thereby indicated. Further, when the main link 31 moves leftward, the connecting shaft 30 will also move leftward, the opening and closing plate 17 will be rocked leftward with the pivot shaft 16 as the center by the return spring 19, and the movable contact 10*a* of the movable contactor 10 is separated from the fixed contact 15 to break the current path.

On the other hand, the trip operation in the case when a comparatively large excessive current flows due to a short-circuiting or the like is shown in FIG. 6B. In this case, the excessive current generates a magnetic flux in the coil 52 of the senser 7, which attracts the movable iron core of the plunger 50 to the fixed iron core and the movable iron core is shifted leftward in the drawing. Therefore, the end part 50*c* of the plunger 50 pushes the pressure sensing part 42 of the tripping lever 39, whereby the tripping lever 39 is rotated to trip the latch link 36 off the hook 40. At the same time, the plunger end 50*b* on the other retracted side forcibly pulls the movable contactor 10 with the flange 50*a*, and the movable contactor 10 is operated to separate from the fixed contact 15 through the trip linkage of the trip link 34, turning link 25 and main link 31. In such case, the movable contactor 10 will rock against the force of the spring 19 about the connecting shaft 30 of the opening and closing plate 17 and the bearing groove 17*a* will move with respect to the pivot shaft 16. Further, the handle 22 will be maintained in the neutral state in the same manner as in the foregoing case of FIG. 6C.

The operation of resetting the handle 22 from the neutral position, that is, from the trip state of FIG. 6B or 6C to the OFF-state in FIG. 6A is made as follows. That is, when the handle 22 is rotated leftward, the handle link 21 is inclined, the turning shaft 24 turns right and upward and the interlinking shaft 28 is pulled up from the positioning edge part 29*a* of the frame by the turning link 25 accordingly the trip link 34 is moved right and upward, the main link 31 is moved left and upward, the movable shaft 33 is pulled back by the trip link 34 within the vertical slots 37 of the latch link 36 so as to urge this link 36 to be rotated, and the engaging hole 36*b* is again locked with the hook 40 of the tripping lever 39 returned by the return spring 44. As a result, the OFF-state shown in FIG. 6A is achieved. Provided the handle 22 is rotated rightward in the tripped state of FIG. 6B or 6C to directly achieve the ON-state, the handle link 21 is rotated leftward in the drawing about the shaft 20 so as to depress the interlinking shaft 28 and main link 31 through the turning link 25. However, the trip link 34 and its movable shaft 33 connected to the interlinking shaft 28 are only shifted leftward since, at this time, the latch link 36 is released from the engagement with the tripping lever 39, whereby the main link 31 is only caused to rotate about the shaft 30 and is unable to rotate the movable contactor 10. Accordingly, the ON-state cannot be achieved unless the main link 31 achieves the normal OFF-state wherein the main link 31 can push the contactor 10 and the engagement of the latch link 36 with the lever 39.

As has been described above, the respective manual changeovers from the OFF-state to the ON-state, from the ON-state to the OFF-state and from the trip state to the OFF-state always accompanied by the engaging relations between the latch link 36 and tripping lever 39 are made by the handle 22 engaging in common directly with the handle levers 21 in the respective breaker element assemblies for the all poles. On the other hand, the trip operation accompanying the operation of the excessive current senser 7 or bimetal 8 responsive to the excessive current in either one of the assemblies is transmitted synchronously to all other assemblies through the interlinking rod 54 engaging in common directly with the respective latch links 36 and tripping levers 39 in the all assemblies in the same manner through the three pairs of legs 54*a* and 54*b* and the synchronous trip of the all assemblies is attained.

Reference now is to a formation and operation of a trip operation interlinking rod 154 in another embodiment of the present invention with reference to FIGS. 7A and 7B. This interlinking rod 154 has a trip operation checking lever 154*c* in addition to three pairs of legs 154*a* and 154*b* provided on a shaft of a length extending over the all assemblies so as to engage the latch links 36 and tripping levers 39 of the respective assemblies in the same manner as in the case of the foregoing embodiment. This lever 154*c* projects out of the shaft in a direction different from those of the legs 154*a* and 154*b* and is positioned so as to be accessible to the assembling worker or inspecting worker when the cover 2 is removed. When this checking lever 154*c*, in the position shown by the dotted line in FIG. 7B in the case of the ordinary OFF-state in FIG. 6A, is pushed with a finger so as to rotate to the position shown by the solid line in the same drawing, the three legs 154*b* will synchronously push the engaging projections of the tripping levers 39 of the all assemblies to rotate the levers 39 against the forces of the spring 44. Thus, the latched state of the latch link 36 will be released and, in exactly the same manner as in the case of the foregoing trip operation, the force of the contact returning spring 19 acting on the movable contactor 10 will be activated to attain the OFF-state. Therefore, in the integrally assembled state of the all assemblies or in the state where the assembled circuit breaker is installed to a powerboard or the like, the trip operation can be simply inspected without requiring any manual pushing of the lever 39 with a thin driver or the like or experimentally flowing of an excessive current.

When the movable contactor in the ON-state is separated from the fixed contact to break the circuit by the handle operation or the arbitrary tripping operation, there is generated a discharge arc between the movable contact 10*a* and the fixed contact 15. This arc is magnetically expanded to shift from the arc running plate 14' of the arc suppressing means 5 to its continuous lower running plate 57. The arc is then enlarged to be across this lower plate 57 and the upper arc running plate 45 so as to be carried to the grid 62, divided therein into pieces and thereby suppressed. Arc gas is discharged through the exhaust plate 61 to the exterior from the gas venting hole 58.

With respect to the arc generated remarkably in the case when the tripping operation is performed as specifically the senser 7 operates responsive to the excessive current, the foregoing so-called current limiting type arc suppressing means is advantageous. However, there is a possibility that the arc is also generated between the fixed contactor 14 and the flanged end 50*a* of the senser's plunger specifically in the event where the plunger end 50*a* projects out of the surface of the movable contactor 10 when the end 50*a* engages therewith at a position relatively closer to the fixed contact at the time of the tripping for rotating the movable contactor. This influences the breaking performance and component elements. In FIGS. 8A and 8B, there is shown a further embodiment which can prevent such arc generation. In this embodiment, the opening and closing plate 17 has a coupling part 17' which, is transverse to the movable contactor 10 to surfacially engage therewith at a position sufficiently remote from the fixed contactor 14. The movable contactor 10 is coupled integrally as calked to this part 17'. On the other hand, the movable contactor 10 is provided with a hole formed in such manner as will hereinafter referred to for passing therethrough the flanged end 50*a* of the sensor plunger. That is, the contactor 10 is provided with a recess 66 formed to project on the side of the sensor 7 or at least to be recessed on the side of the fixed contactor. A hole 67 of a size capable of passing through the flanged end 50*a* is made above the recess 66. A groove 68 is made in the center of the recess to communicate with the hole 67 but to allow only the plunger 50*b* to pass the groove slidably. Thus, the flanged end 50*a* will be passed through the hole 67 and received inside the recess 66 with the plunger 50*b* positioned in the groove 68 and the outer end surface of the flanged end 50*a* will be at least flush with the surface of the movable contactor 10 on the fixed contactor side or will be within the recess 66. With this arrangement, the movable contactor 10 has no projected part except the movable contact 10*a* adjacent the opposing fixed contactor 14. Thus, the arc generation between the fixed contactor and the plunger's flanged end can be effectively prevented and any burning damage of the plunger end which gives influences on the high speed tripping and the life of the device can be well prevented.

As has been described in the foregoing, in the multipolar type circuit breaker according to the present invention, a plurality of the breaker element assemblies for the respective phases each comprise the both fixed and movable contactors, current source side and load side terminals connected to the respective contactors, a contact operating mechanism operating the movable contactor, a trip mechanism interlinked to the contact mechanism and electrically connected between the movable contactor and the load side terminal and means for suppressing arcs occurring between the contacts of both contactors are contained as aligned with and insulated from each other in the same housing. In providing the positioning means for aligning the respective assemblies in the parts of fitting them, the alignment of the respective assembly can be easily attained with a high precision, and costs for the plurality of cases conventionally required for the assemblies can be made at a low cost. The synchronism of the trip operations of the respective assemblies is, however still made easy to obtain. Thus, the plurality of assemblies arranged as aligned with each other with a high precision in the single housing are interlinked through a single trip operation interlinking rod. This rod is engaged directly in common with the tripping levers of the trip mechanisms in the respective assemblies and the latch links connected with the tripping levers so as to latch the movable contactors in contact with the fixed contacts and to forcibly trip them. Therefore the trip operation taking place in either one of the assemblies is transmitted to the other assemblies reliably with a high synchronism. At the same time, there can be provided a single handle which engages directly in common with the handle link acting in common with (i) the linkage of the contact operating mechanism which turns the movable contactor between the ON-OFF positions, (ii) with the fixed contact and (iii) with the linkage of the trip mechanism which latches the movable contactor in the ON-position and forcibly trips the contactor from the ON-position in the respective assemblies. The ON-OFF operations for all the assemblies can be made reliably with a high synchronism. As the handle is held in the neutral positions of the spring forces of the respective linkages, the indication of the trip state can be very easily attained with the single handle. The common single interlinking rod and handle's main shaft part can be also contained in the single case and, therefore, the entire breaker can be formed to be very compact.

In the indication of the trip state by the neutral position of the handle, the interlinking shaft between the both linkages is led at both ends through the windows made in the frame holding the component elements of each assembly and the projections engaging with such shaft in the trip state position between the ON-OFF positions are provided in the windows, whereby the neutral position of the handle indicating the trip state can be positively and easily maintained.

In the breaker assemblies for the respective poles conventionally contained in the respective separate cases a handle has been pivoted and engaged through a pin or the like with the connecting member of the contact operating mechanism with the trip mechanism and then a rotary shaft of the handle has been fitted through the handle. In all of the cases, according to the present invention, further, the handle link, which is a connecting member for the both mechanisms, is pivoted at one end to the handle supporting shaft fixed to the frame and has a connecting part intermediately between this end and the other end connected to the turning link connected to both mechanisms in the respective assemblies. The handle engaged in common with all the assemblies is adapted to have the connecting parts of the handle links in all the assemblies held between the holding legs and is fitted to the assemblies as mounted only on the handle supporting shafts of the assemblies. Thus, the engagement and disengagement of the common handle with all the assemblies can be made in a very simpler manner. Further, in checking the operational performance of the respective mechanisms, a direct rotation of the handle link pivoted to the handle supporting shaft is made possible so that the ON-OFF test operations can be made without using the handle. A formation advantageous particularly to check the operations of the individual assemblies is provided. The trip operation of each assembly can be simply checked by first obtaining the ON-state with the operation of the handle or handle link and then manually rotating the tripping lever to release it from the latch link. In respect of the synchronous trip operation, a manual operation of the single interlinking rod engaged in common with the respective tripping levers and latch links in all the assemblies is made possible so that the operation to be transmitted synchronously throughout the respective assemblies can be tested very simply with a high precision. In this respect, it is advantageous particularly in checking the performance of synchronous trip motion transmission to provide a checking lever additionally to the interlinking rod for such transmission.

Referring to the latch load imparted to the trip mechanism and interlinking rod upon the trip operation, that is, the force required for releasing the engagement of the tripping lever 39 with the latch link 36, the particular latch link 36 in the ON-state of FIG. 3 receives the force of the return spring 19 which is imparted through the contact opening and closing plate 17, main link 31 and trip link 34. This force acts, when the latch link is disengaged with the tripping lever 39, to rotate the latch link 36 about its pivot shaft 35 so as to push up one of the legs 54*a* of the rod 54. Thus, an acting force of the spring 19 exists in either case of the operations of the excessive current senser 7 and bimetal element 8. Specifically when the plunger head 50*a* of the senser 7 draws the movable contactor, the force of the spring 19 acts to assist such drawing. Therefore, the force which either of the plunger and bimetal element requires for disengaging the tripping lever from the latch link should be a frictional engaging force between the lever and the link and the one resistive to the biasing force of the spring 44 biasing always the lever in the direction of engagement with the link. The required force can be made almost to be only the one resistive to that of the spring 44 when the engaging area of the lever 39 with the link 36 is made as small as possible. Yet, this resistive force, that is, the latch load in the individual assembly equals only to the force of the spring 44 in the individual assembly and the load in any other assembly is not contributive. Further, such trip operation in each assembly causes the foregoing rotation of the latch link 36 due to the return spring 19 to hit the leg 54*a* of the interlinking rod 54 to axially rotate the rod. This rotation of the rod results in the pushing of the levers 39 by the other legs 54*b* to disengage the levers from the latch links 36 in the respective other assemblies. Therefore, in the case of the 3-phase source current, the force which the interlinking rod 54 requires upon its axial rotation for transmitting the trip operation in one assembly to the other two assemblies is substantially equal only to a total force of two springs 44. The return spring 19 in each assembly acting for such rotation of the rod through the latch link 36 is provided with an enough force for well resisting against such two springs 44. According to the present invention, therefore, any special consideration is not requested for resisting against the latch load upon the trip operation by means of either of the excessive current senser and bimetal element, whereby the arrangement in this respect of the individual assembly as well as the entire breaker including the all assemblies can be simplified and the trip operation can be rapidly and synchronously transmitted throughout the assemblies with a light load.

The foregoing embodiments are shown as being of the circuit breaker including three of the breaker element assemblies for use with the 3-phase alternating source current, and the case forming the breaker housing is shown to be provided with three sets of the grooves and alignment mounting means for housing and mounting the respective three assemblies. While, in the case of the single-phase AC source, the case may be provided with two sets of the groove and mounting means to be adapted to two assemblies, the illustrated arrangement for the three assemblies may also be utilized by, for example, dismounting only the central one of the three assemblies and leaving the two assemblies on the both outer sides and the interlinking rod and handle engaging with these two as they stand, with the central groove left vacant. In other words, further, the respective one of the plurality of breaker element assemblies for all of the source current poles may be subjected to the maintenance check or the like as freely dismounted from the arrangement in which the assemblies are integrally combined within the single housing.

What is claimed is:

1. A multipolar type circuit breaker including a plurality of breaker element assemblies for alternating source current poles respectively comprising a fixed contactor having a fixed contact and connected to a source side terminal, a movable contactor supported movably between ON and OFF positions of its movable contactor with said fixed contact, a contact operating mechanism for changing over said movable contactor between said positions, and a trip mechanism interlinked with said operating mechanism to form a current path between the movable contactor and a load side terminal and including means which normally latches the movable contactor at its ON position but releases the latching upon incoming of an excessive current for forcibly tripping the movable contactor out of the ON position, said assemblies respectively having a handle link pivoted at one end to a fixed handle supporting shaft and operably connected at the other end to said contact operating mechanism, the respective assemblies being housed in a single housing respectively with said handle supporting shaft and tripping means in alignment with each other, said handle link in each of the assemblies being directly operated by a single handle engaging directly with all the assemblies, and said tripping means in the respective assemblies being interlinked to each other by an interlinking rod engaged to the respective means for transmitting said forcible trip operation in either one of the assemblies synchronously with the means in the other assemblies, said handle comprising a main shaft part extending within said housing transversely of said plurality of assemblies while engaging said handle supporting shaft and handle link in the respective assemblies to be axially rotatable about the handle supporting shaft, and a lever part extending from said main shaft part to the exterior of said housing, and said interlinking rod extends within the housing transversely of the assemblies and is supported axially rotatably, said interlinking rod being provided with a plurality of projections respectively engageable with said tripping means in the respective assemblies, said trip mechanism including an excessive current sensing means forming said current path, said tripping means comprising a latch link connected at one end to said contact operating mechanism and having at the other end a latch engaging part, said latch link being rotatably supported substantially at an intermediate position by a fixed shaft, and a tripping lever having at one end a first part engageable with said latch engaging part of said latch link for achieving a latch engagement therewith and at the other end a second part engageable with said sensing means, said tripping lever being rotatably supported substantially at the center about a fixed shaft normally biased toward engagement with the detecting means, said plurality of projections of said interlinking rod respectively comprising a pair of legs, a first one of which extending close to the latch engaging part of the latch link and a second one of which extending close to said first part of the tripping lever, such that a force imparted to either one of said first and second legs by a rotation of either one of the latch link and tripping lever causes the interlinking rod to be axially rotated.

2. A circuit breaker according to claim 1 wherein said interlinking rod has a check lever extending from the axial line in a different direction from respective ones of said legs of said pairs, and a rotary force given through said check lever to the rod causes respective ones of said second legs of the respective pairs to release said latch engagement between said tripping lever and said latch link.

3. A circuit breaker according to claim 1 wherein said housing comprises a case for mounting thereon respective ones of said plurality of assemblies mutually in alignment and has a partition wall which electrically insulates adjacent ones of the assemblies, and a cover is fited to said case for covering the respective assemblies while exposing only said terminals and said lever part of said handle.

4. A circuit breaker according to claim 3 wherein said movable contactor, contact operating mechanism and trip mechanism in each of said assemblies are supported between a pair of opposing frame plates, said frame plates in the respective assemblies are provided at least with a pair of side projections at an identical position, and said case is provided at mutually aligned positions in a direction transversely of the assemblies with a plurality pair of grooves receiving respective ones of said pairs of said side projections of the frame plates for positioning all the assemblies in alignment with each other.

5. A circuit breaker according to claim 4 wherein said handle supporting shaft in respective ones of said assemblies and said interlinking rod common to all the assemblies are respectively supported by a projection provided in said plurality of pairs of said frame plates at positions extending beyond said partition wall of said case.

6. A circuit breaker according to claim 1 wherein, in each of said plurality of assemblies, said movable contactor receives a force normally biasing said movable contact in a direction away from said fixed contact, said tripping means receives a biasing force in a direction normally latching the movable contactor at said ON position against said separating biasing force, and a latch releasing of the respective tripping means interlinking throughout all the assemblies is performed only against said latching directional biasing force, while the separating biasing force is contributive to said latch releasing.

7. A circuit breaker according to claim 6 wherein said trip mechanism in respective ones of said assemblies includes an excessive current sensing means forming said current path, said tripping means comprises a latch link supported substantially in the middle to be rotatable about a fixed shaft, said link being connected at one end to a linkage between said handle link and said contact operating mechanism and having at the other end a latch engaging part, and a tripping lever rotatable and engageable at one end with said sensing means and at the other end with said latch engaging part of said latch link as biased by said latching directional biasing force but to release said engagement with the latch link against the latching directional force responsive to an actuation of the sensing means, said latch link is released from said engagement of said tripping lever by said separating biasing force for the movable contactor upon a rotation of the tripping lever, and said interlinking rod has an interlinking means extending close at least to one of said latch engaging part of the latch link and the other end of the tripping lever of the tripping means in the respective assemblies.

8. A circuit breaker according to claim 7 wherein said one end of said latch link is coupled to said linkage of said handle link and contact operating mechanism through means for normally biasing the handle link and handle toward their position of said contact ON position, and said latch link shifts to a position where said biasing means holds the handle link at an intermediate position of said handle between its both positions relative to said contact ON and OFF positions upon a rotation for releasing said latching engagement with said tripping lever, whereby the handle indicating a tripped state of said current path.

9. A circuit breaker according to claim 7 wherein said excessive current sensing means includes an electromagnetic means comprising a coil inserted in said current path and a plunger carrying a movable iron core attracted to a stationary iron core as excited by an excessive current flowing through said coil, said one end of said tripping lever is engageable with an end of said plunger projected out of said electromagnetic means upon said attraction, the other end of the plunger on the side retreated upon the attraction passes through a through hole made in said movable contactor and has a flange which engages with the contactor at peripheral edges of said through hole for separating the movable contactor from said fixed contactor upon the attraction, and said peripheral edge of the through hole is recessed for receiving said flange of the plunger.

* * * * *